US008963055B2

(12) United States Patent
Liu et al.

(10) Patent No.: US 8,963,055 B2
(45) Date of Patent: Feb. 24, 2015

(54) CONTROL DEVICE FOR HEAT ROLLER

(75) Inventors: Dong Liu, Shanghai (CN); Xi Xu, Shanghai (CN)

(73) Assignee: Ricoh Company, Ltd., Tokyo (JP)

( * ) Notice: Subject to any disclaimer, the term of this patent is extended or adjusted under 35 U.S.C. 154(b) by 347 days.

(21) Appl. No.: 13/408,289

(22) Filed: Feb. 29, 2012

(65) Prior Publication Data

US 2012/0248089 A1 Oct. 4, 2012

(30) Foreign Application Priority Data

Mar. 31, 2011 (CN) ..... 2011 1 0091205

(51) Int. Cl.
*H05B 1/02* (2006.01)
*G03G 15/20* (2006.01)

(52) U.S. Cl.
CPC ..... *G03G 15/205* (2013.01)
USPC ..... 219/494; 219/490

(58) Field of Classification Search
CPC ..... G03G 15/205
USPC ..... 219/490, 469, 216
See application file for complete search history.

(56) References Cited

U.S. PATENT DOCUMENTS 4,801,974 A * 1/1989 Suto et al. ..... 399/33
4,821,069 A * 4/1989 Kusumoto ..... 219/216
4,839,698 A * 6/1989 Inuzuka et al. ..... 399/9
5,334,817 A * 8/1994 Nakamori et al. ..... 219/492
6,647,218 B2 * 11/2003 Takayama ..... 399/33
6,778,789 B2 * 8/2004 Cho et al. ..... 399/69
7,109,449 B2 * 9/2006 Kawase ..... 219/619
7,242,880 B2 * 7/2007 Sone et al. ..... 399/33
2009/0214234 A1 * 8/2009 Fujii et al. ..... 399/33

FOREIGN PATENT DOCUMENTS

JP 2004-77595 3/2004
JP 2008-304848 12/2008

* cited by examiner

*Primary Examiner* — Henry Yuen
*Assistant Examiner* — Alba Rosario-Aponte
(74) *Attorney, Agent, or Firm* — Oblon, Spivak, McClelland, Maier & Neustadt, L.L.P.

(57) ABSTRACT

Disclosed is a heat roller control device comprising a high temperature malfunction detection unit configured to receive a temperature value detected by a heat roller temperature sensor; an electrical power control unit configured to cut off, when receiving a high temperature malfunction detection signal, power feeding to a heat roller from an electrical power unit; an analog-to-digital converter configured to periodically convert plural of the temperature values from the heat roller temperature sensor to plural digital temperature values; a temperature value storage unit configured to receive and store the plural digital temperature values from the analog-to-digital converter; a temperature value processing unit configured to read and process the plural digital temperature values stored in the temperature value storage unit; and a high temperature malfunction determination unit configured to receive the processed data, and then based on the processed data, determine whether high temperature malfunction occurs.

7 Claims, 3 Drawing Sheets

(a) WITHOUT NOISE INFLUENCE (b) WITH NIOSE INFLUENCE

CONTROL DEVICE FOR HEAT ROLLER

BACKGROUND OF THE INVENTION

1. Field of the Invention

The present invention relates to a control device for a heat roller, and especially relates to a control device configured to control heating carried out with regard to a heat roller.

2. Description of the Related Art

As for an image formation apparatus such as a printer, a copier, etc., during a process of fusing (i.e. fixing) a toner image to a recording medium such as a piece of paper, etc., by utilizing heat treatment, it is necessary to carry out control with regard to a heat roller (also called "fuser roller") so as to avoid damage to the image formation apparatus, caused by overheating of the heat roller.

In conventional techniques, a control device such as a CPU, etc., is used to carry out monitoring with regard to temperature, and based on the detected temperature, to perform corresponding temperature adjustment control with regard to the heat roller. In this control process, if it is detected that the temperature is too high, then power feeding to the heat roller for heating is cut off.

In addition, aside from software stored in a control device such as a CPU, etc., hardware such as a circuit, etc., may also be utilized to forcibly cut off control carried out with regard to the heat roller. In this kind of hardware, for example, a circuit is usually formed of a comparator and a latch. The comparator is used to carry out comparison between voltage obtained from a temperature sensor and reference voltage of high temperature malfunction. If the voltage obtained from the temperature sensor (i.e., the voltage corresponding to the current temperature obtained by the temperature sensor) exceeds a predetermined reference voltage for high temperature malfunction (i.e., the voltage corresponding to a high temperature threshold value $T_H$), the comparator outputs a high temperature malfunction signal, and then the latch latches this state and cuts off power feeding to the heat roller.

After the image formation apparatus is stopped and restarted, in order to prevent continuous heating of the heat roller, when the high temperature malfunction signal is generated, it is necessary to store a high temperature malfunction code into an electrically erasable programmable read-only memory (EEPROM) in general. Once the high temperature malfunction code is stored into the EEPROM, the image formation apparatus cannot start according to a normal start method so as to avoid damage to the image formation apparatus that would be caused by the further heating of the heat roller. If the high temperature malfunction code stored in the EEPROM needs to be erased, it is necessary to artificially carry out an erase operation.

Furthermore, due to influence of noise caused by, for example, static electricity, a false operation may occur in the above described circuit so as to cause wrong detection of high temperature malfunction. For example, in a case where high temperature malfunction does not exist, it is possible to detect temperature within a normal temperature range as high temperature due to influence of noise, etc., so as to cause wrong detection of high temperature malfunction, as shown in (b) of FIG. 1. As a result, although high temperature malfunction does not exist in the heat roller, it is possible for a normal condition to be detected as a high temperature malfunction; then, since a high temperature malfunction code is written into the EEPROM, it is necessary to artificially carry out a dedicated operation to erase the high temperature malfunction code. This may cause inconvenience on use.

In the conventional techniques, for example, in the below cited reference No. 1, a method of detecting high temperature malfunction is disclosed. However, this reference does not mention how to avoid a problem of influence caused by noise occurring in a circuit.

In order to remove this kind of influence possibly existing in a circuit, and to further improve accuracy of high temperature malfunction detection, it is necessary to develop a more stable and reliable control device for the heat roller.

In addition, although those people skilled in the art may know that it is possible to employ a noise filter to remove noise so as to avoid this kind of problem, this may call for hardware and cost increase.

Cited Reference No. 1: Japan Patent Application Publication No. 2004-77595

SUMMARY OF THE INVENTION

In order to overcome the above described disadvantages of the prior art, in embodiments of the present invention, a control device for a heat roller (hereinafter called "heat roller control device") is proposed by which noise influence existing in a circuit may be removed so that accuracy of high temperature malfunction detection may be improved. In addition, the heat roller control device is stable, so there is no need to introduce new constructional elements in the circuit nor increase cost of the circuit.

According to one aspect of the present invention, a heat roller control device configured to control heating carried out with regard to a heat roller of an external fuser unit by controlling an external electrical power unit is provided. The heat roller control device comprises a high temperature malfunction detection unit configured to receive a temperature value from a temperature sensor of the heat roller, and when the temperature value is greater than or equal to a predetermined high temperature threshold value, generate a high temperature malfunction detection signal, and send the high temperature malfunction detection signal to an electrical power control unit and a temperature value processing unit; the electrical power control unit configured to cut off, when receiving the high temperature malfunction detection signal, power feeding to the heat roller carried out by the electrical power unit so as to stop the heating of the heat roller; an analog-to-digital converter (ADC) configured to periodically convert temperature values from the temperature sensor to digital temperature values; a temperature value storage unit configured to receive and store the digital temperature values from the ADC; the temperature value processing unit configured to read and process, when receiving the high temperature malfunction detection signal, plural digital temperature values stored in the temperature value storage unit, and send the processed data to a high temperature malfunction determination unit. The plural digital temperature values refer to digital temperature values corresponding to a specified detection time point generating the high temperature malfunction detection signal and a predetermined number of detection time points backward from the specified detection time point; the high temperature malfunction determination unit is configured to receive the processed data, and based on the processed data, determine whether high temperature malfunction occurs. If it is determined that the high temperature malfunction occurs, then the high temperature malfunction determination unit generates a high temperature malfunction code, and writes the high temperature malfunction code into a read-only memory.

According to the above aspect of the present invention, since the digital temperature values are processed, and the high temperature malfunction is determined based on the processed data, it is possible to provide a heat roller control device and an image formation apparatus adopting the same on the basis of not including new constructional elements of a circuit as well as not increasing the cost of the circuit. In addition, the heat roller control device may not be affected by noise.

DETAILED DESCRIPTION OF THE PREFERRED EMBODIMENTS

Hereinafter, various embodiments of the present invention will be concretely described with reference to the drawings. However it should be noted that the same symbols, which are in the specification and the drawings, stand for constructional elements having the basically-same function and structure, and repeated explanations for the constructional elements are omitted.

Figure 1:
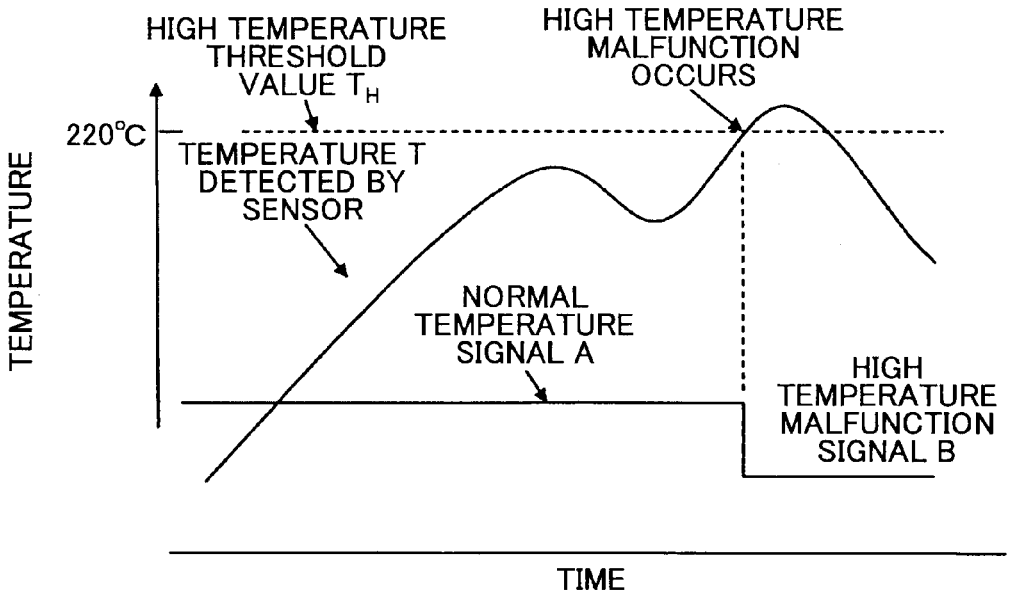
FIG. 1 illustrates an example of comparison of high temperature malfunction detection results; (a) illustrates a high temperature malfunction detection result without noise influence, and (b) illustrates a high temperature malfunction detection result with noise influence.
Figure 1:
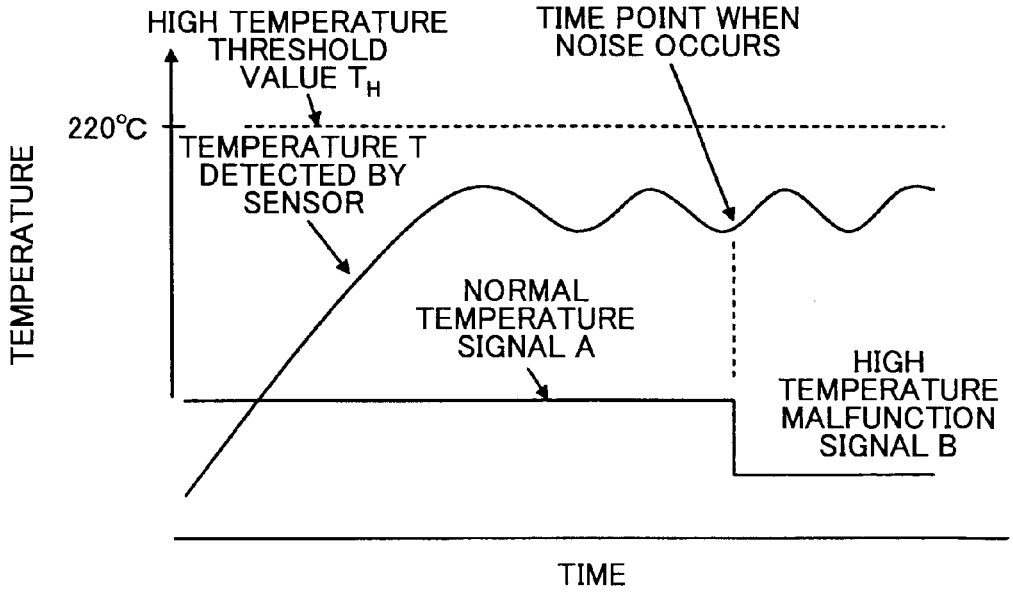
Figure 2:
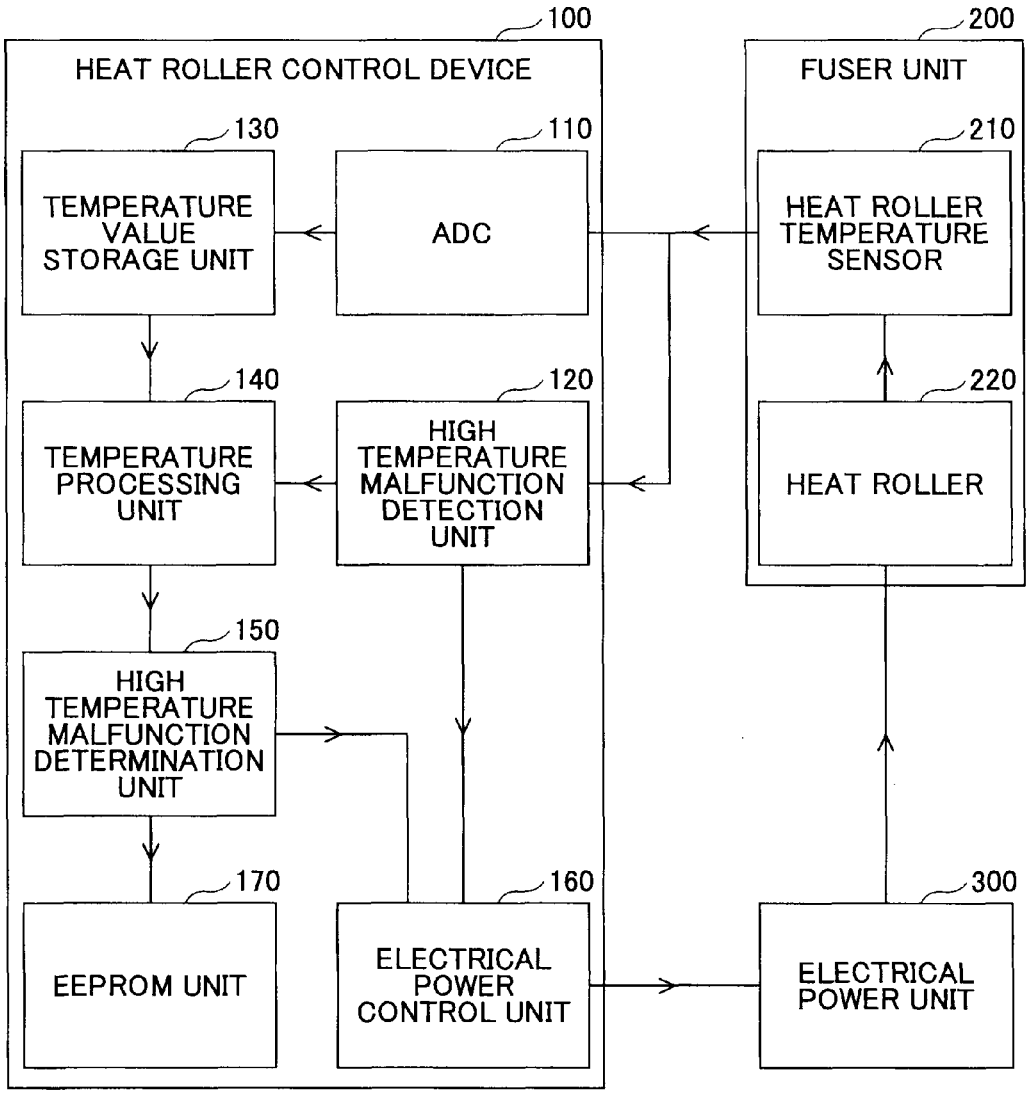
FIG. 2 is a structural block diagram of a heat roller control device according to an embodiment of the present invention.

FIG. 2 is a structural block diagram of a heat roller control device 100 according to an embodiment of the present invention.

Functional units of the heat roller control device 100 will be concretely illustrated by referring to FIG. 2.

Here it should be noted that all or parts of the functional units of the heat roller control device 100 may be embedded in or utilize a control device such as a CPU, etc., in an image formation apparatus.

In addition, in order to illustrate easily, in all of the following embodiments of the present invention, a case where a high temperature threshold value $T_H$ is set to 220° C. is taken as an example for illustration. However, those people skilled in the art should understand that the high temperature threshold value $T_H$ may also be set to other proper values according to various actual circumstances of the image formation apparatus, for example, a printer.

The heat roller control device 100 according to the embodiment of the present invention controls an electrical power unit 300 so as to achieve heating control with regard to a heat roller 220 in a fuser unit 200. As shown in FIG. 2, the heat roller control device 100 includes an analog-to-digital converter (ADC) 110, a high temperature malfunction detection unit 120, an electrical power control unit 160, a temperature value storage unit 130, a temperature value processing unit 140, a high temperature malfunction determination unit 150, and an electrically erasable programmable read-only memory (EEPROM) unit 170 (or a read-only memory unit).

In what follows, the respective functional units of the heat roller control device 100 are concretely illustrated.

The ADC 110 is configured to periodically convert, based on its internal sampling period, temperature values detected by a heat roller temperature sensor 210 to digital temperature values. In addition, the temperature values detected by the heat roller temperature sensor 210 refer to voltage values or electrical current values output by the heat roller temperature sensor 210, corresponding to temperatures of an object waiting for detection (i.e., temperature of the heat roller 220). The digital temperature values are digital values corresponding to the respective temperatures, obtained by carrying out the conversion at the time points of the periodic detection according to the internal sampling period of the ADC 110. In general, the ADC 110 temporarily stores a currently obtained (converted) digital temperature value into its internal register. The digital temperature values temporarily stored in the register of the ADC 110 are sent to the temperature value storage unit 130 in series. Alternatively it may be understood that the temperature value storage unit 130 reads the digital temperature values from the register of the ADC 110 in series.

The temperature value storage unit 130 may arbitrarily set, based on actual needs, the number of digital temperature values able to be stored. That is, it is possible to store digital temperature values corresponding to an arbitrarily predetermined number of detection time points backward from a current detection time point.

The high temperature malfunction detection unit 120 creates a high temperature malfunction detection signal based on an analog temperature signal from the heat roller temperature sensor 210. The high temperature malfunction detection unit 120 may be formed of, for example, a comparator and a latch. The analog temperature signal of the heat roller temperature sensor 210 is input into an input terminal of the comparator. The comparator compares a temperature value corresponding to the analog temperature signal of the heat roller temperature sensor 210 with a predetermined high temperature threshold value $T_H$, and outputs a comparison result. This comparison result is latched by the latch; after that, although the comparison result is changed, the state of the latch is unchanged. For example, in the embodiment of the present invention, when a temperature value of the heat roller 220 is less than the high temperature threshold value $T_H$, the comparator outputs a high level signal; once a temperature value of the heat roller 220 at a time point is greater than or equal to the high temperature threshold value $T_H$, the comparator outputs a low level signal, and the latch latches this low level signal. In this way, after that, although a temperature value of the heat roller 220 decreases to be less than or equal to the high temperature threshold value, the state of the latch is unchanged, i.e., is maintained at a low level state. The high temperature malfunction unit 120 may generate a high temperature malfunction detection signal based on the low level signal, and output the high temperature malfunction detection signal to the electrical power control unit 160 and the temperature value processing unit 140, or directly output the low level signal serving as a high temperature malfunction detection signal to the electrical power control unit 160 and the temperature value processing unit 140.

As long as the electrical power control unit 160 receives the high temperature malfunction detection signal, the electrical power control unit 160 controls the electrical power unit 300 at once so as to cut off power feeding to the heat roller 220 from the electrical power unit 300. As a result, heating of the heat roller 220 is stopped.

When the temperature value processing unit 140 receives the high temperature malfunction detection signal, the temperature value processing unit 140 reads plural digital temperature values from the temperature value storage unit 130. Here the plural digital temperature values refer to a digital temperature value corresponding to a detection time point generating the high temperature malfunction detection signal and digital temperature values corresponding to a few continuous detection time points of the ADC 110 backward from the detection time point generating the high temperature malfunction detection signal. Then the temperature value processing unit 140 carries out processing with regard to the obtained (read) plural digital temperature values, and then sends processed data to the high temperature malfunction determination unit 150.

The high temperature malfunction determination unit 150 determines, based on the processed data, whether high temperature malfunction occurs.

If it is determined that the high temperature malfunction has occurred, then the high temperature malfunction determination unit 150 generates a high temperature malfunction code, and writes the high temperature malfunction code into the EEPROM unit 170 such as an EEPROM, etc. After that, although the image formation apparatus is restarted, it is impossible to erase the high temperature malfunction code stored in the EEPROM unit 170; as a result, although the electrical power unit 300 is restarted, it is impossible to carry out power feeding to the heat roller 220. At this time, the high temperature malfunction code stored in the EEPROM 170 has to be removed artificially (manually). In this way, it is convenient to maintain the image formation apparatus, and it is easy to prevent unsuitable processing.

If it is determined that the high temperature malfunction does not occur, the high temperature malfunction determination unit 150 may not carry out any operations until the electrical power unit 300 of the image formation apparatus is restarted artificially.

On the other hand, in order to operate conveniently, if it is determined that the high temperature malfunction does not occur, the high temperature malfunction determination unit 150 may send a restart signal to the electrical power control unit 160. The electrical power control unit 160 automatically restarts the electrical power unit 300 based on the restart signal so as to provide electrical power to the heat roller 220 for heating.

Alternatively, if it is determined that the high temperature malfunction does not occur, the high temperature malfunction determination unit 150 may send a message saying the high temperature malfunction has not occurred, to a notification unit (not shown in the drawings). By outputting, for example, displaying or speaking, the message by the notification unit, it is possible to draw attention to artificially restarting the electrical power unit 300. The notification unit may be a LED display unit, a speaker, etc.

In addition, by employing the temperature value processing unit 140, it is possible to carry out, based on actual needs, selection of a processing method performed with regard to a temperature value. The high temperature malfunction determination unit 150 may carry out, based on different processing data obtained according to different processing methods, corresponding high temperature malfunction determinations. Furthermore the high temperature malfunction determination unit 150 may also carry out high temperature malfunction determination by combining different processing data obtained according to different processing methods. A few embodiments are provided for carrying out concrete descriptions as follows.

Embodiment 1

Embodiment 1 gives an example of determining whether high temperature malfunction occurs, based on an average value of plural digital temperature values.

In embodiment 1, when receiving a high temperature malfunction detection signal from the high temperature malfunction detection unit 120, the temperature value processing unit 140 reads, from the temperature value storage unit 130, a digital temperature value corresponding to a detection time point generating the high temperature malfunction detection signal and digital temperature values corresponding to plural detection time points backward from the detection time point generating the high temperature malfunction detection signal. Here the plural detection time points backward from the detection time point generating the high temperature malfunction detection signal usually are two to six detection time points. Of course, according to specific determination requirements, the number of the plural detection time points backward from the detection time point generating the high temperature malfunction detection signal may be greater than six.

For example, in a case of calculating an average value of digital temperature values corresponding to a detection time point d generating the high temperature malfunction detection signal and three continuous detection time points d-1, d-2, and d-3 just before the detection time point d, first the temperature value processing unit 140 reads, from the temperature value storage unit 130, digital temperature values T'd, T'd-1, T'd-2, and T'-d3 corresponding to the time points d, d-1, d-2, and d-3; second the temperature value processing unit 140 calculates an average value of these four digital temperature values, i.e., the average value $T'_{ave}$=(T'd+T'd-1+T'd-2+T'd-3)/4.

The high temperature malfunction determination unit 150 receives the average value $T'_{ave}$ serving as processed data, and determines, by comparing the average value $T'_{ave}$ with a predetermined first threshold value $T'_A$, whether high temperature malfunction occurs. An analog temperature value corresponding to the predetermined first threshold value $T'_A$ is $T_A$. For example, in this embodiment, in a case where it is assumed that $T_H$ is 220° C., and the number of selected detection time points is four, it is possible to set the predetermined first threshold value $T'_A$ to a digital temperature value corresponding to 215° C. ($T_A$). That is, the predetermined first threshold value $T'_A$ may be set according to the high temperature threshold value $T_H$, the number of selected detection time points, predetermined work conditions of the image formation apparatus, etc., on the basis that it is possible to effectively determine whether the high temperature malfunction really has occurred in the heat roller 220.

At this time, if $T'_{ave}$ is greater than or equal to $T'_A$, then the high temperature malfunction determination unit 150 determines that the high temperature malfunction has occurred; otherwise it is determined that the high temperature malfunction does not exist.

Embodiment 2

Embodiment 2 gives an example of determining whether high temperature malfunction occurs, based on a maximum value of plural digital temperature values.

In embodiment 2, when receiving a high temperature malfunction detection signal from the high temperature malfunction detection unit 120, the temperature value processing unit 140 reads, from the temperature value storage unit 130, a digital temperature value corresponding to a detection time point generating the high temperature malfunction detection signal and digital temperature values corresponding to plural detection time points backward from the detection time point generating the high temperature malfunction detection signal. Here the plural detection time points backward from the detection time point generating the high temperature malfunction detection signal usually are two to six detection time points. Of course, according to specific determination requirements, the number of the plural detection time points backward from the detection time point generating the high temperature malfunction detection signal may be greater than six.

For example, in a case of calculating a maximum value of digital temperature values corresponding to a detection time point d generating the high temperature malfunction detection signal and three continuous detection time points d-1, d-2, and d-3 just before the detection time point d, first the temperature value processing unit 140 reads, from the temperature value storage unit 130, digital temperature values T'd, T'd-1, T'd-2, and T'-d3 corresponding to the detection time points d, d-1, d-2, and d-3; second the temperature value processing unit 140 calculates a maximum value $T'_{max}$ by comparing these four digital temperature values.

The high temperature malfunction determination unit 150 receives the maximum value $T'_{max}$ serving as processed data, and then determines, by carrying out comparison between the maximum value $T'_{max}$ and a predetermined second threshold value $T'_M$, whether high temperature malfunction occurs. An analog temperature value corresponding to the predetermined second threshold value $T'_M$ is $T_M$. For example, in this embodiment, if it is assumed that $T_H$=220° C. and the number of selected detection time points is four, then the predetermined second threshold value $T'_M$ may be set to a digital temperature value corresponding to 215° C. ($T_M$). That is, the predetermined second threshold value $T'_M$ may be set according to the high temperature threshold value $T_H$, the number of selected detection time points, predetermined work conditions of the image formation apparatus, etc., on the basis that it is possible to effectively determine whether the high temperature malfunction has really occurred in the heat roller 220.

At this time, if it is determined that $T'_{max}$ is greater than or equal to $T'_M$, then the high temperature malfunction determination unit 150 determines that the high temperature malfunction has occurred; otherwise the high temperature malfunction determination unit 150 determines that the high temperature malfunction does not exist.

Embodiment 3

Embodiment 3 gives an example of determining whether high temperature malfunction occurs, based on change tendency of digital temperature values.

In embodiment 3, when receiving a high temperature malfunction detection signal from the high temperature malfunction detection unit 120, the temperature value processing unit 140 reads, from the temperature value storage unit 130, a digital temperature value corresponding to a detection time point generating the high temperature malfunction detection signal and a digital temperature value corresponding to a detection time point just before the detection time point generating the high temperature malfunction detection signal.

The temperature value processing unit 140 carries out comparison between the digital temperature value corresponding to the detection time point generating the high temperature malfunction detection signal and the digital temperature value corresponding to the detection time point just before the detection time point generating the high temperature malfunction detection signal, and represents the comparison result as a flag (i.e. a logical value). If the digital temperature value corresponding to the detection time point generating the high temperature malfunction detection signal is greater than the digital temperature value corresponding to the detection time point just before the detection time point generating the high temperature malfunction detection signal, then the flag is set as "1"; otherwise the flag is set as "0".

The high temperature malfunction determination unit 150 receives the flag serving as processed data. If the flag is "1", then the high temperature malfunction determination unit 150 determines that the high temperature malfunction occurs. If the flag is "0", then the high temperature malfunction determination unit 150 determines that the high temperature malfunction does not occur.

Up to here, three processing methods and their corresponding determination methods carried out with regard to the digital temperature values have been described in the above embodiments 1-3. However, those people skilled in the art should understand that it is also possible to make improvement and extension based on the above embodiments 1-3. For example, it may be considered to combine embodiment 1 and embodiment 2, and to make comprehensive determination based on the respective processing results of embodiments 1-2.

Figure 3:
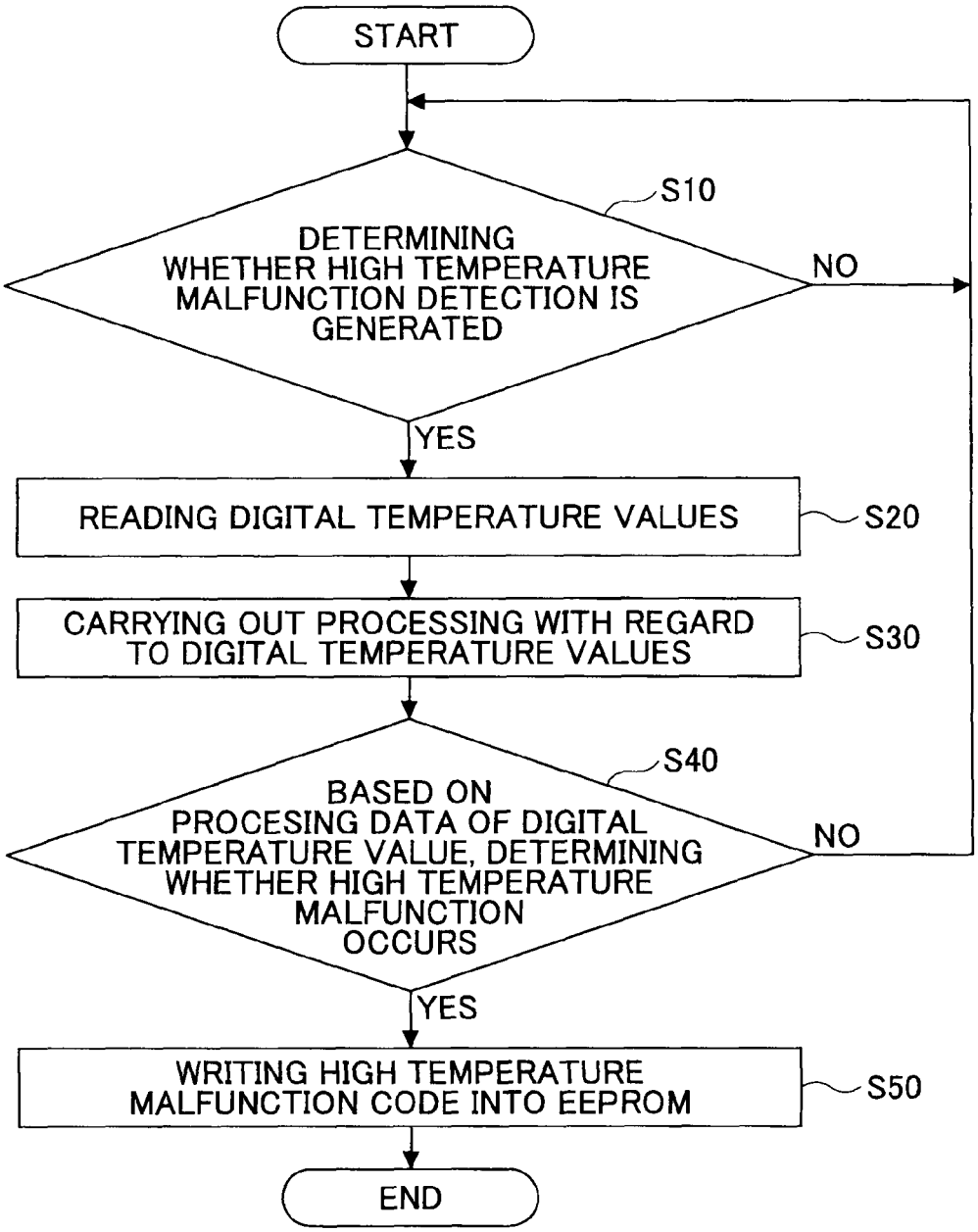
FIG. 3 is a flowchart of high temperature malfunction determination carried out by a heat roller control device according to an embodiment of the present invention.

FIG. 3 is a flowchart of high temperature malfunction determination carried out by the heat roller control device 100, according to an embodiment of the present invention.

In what follows, by referring to FIG. 3, the determination processing of the flowchart is concretely illustrated.

First it is determined whether a high temperature malfunction detection signal is created (STEP S10). If the determination result is that the high temperature malfunction detection signal is created, then the temperature value processing unit 140 reads digital temperature values from the temperature value storage unit 130 based on the high temperature malfunction detection signal (STEP S20). Second, the temperature value processing unit 140 carries out processing with regard to the read digital temperature values (STEP S30). The processing method may adopt one of those described in the above embodiments 1-3. If the determination result obtained in STEP S10 is that the high temperature malfunction detection signal is not created, then the determination processing goes back to STEP S10.

After STEP S30, the high temperature malfunction determination unit 150 determines, based on the obtained processing data up to here, whether high temperature malfunction occurs (STEP S40). Here it should be noted that a criterion for the determination needs to be adjusted according to an actually adopted processing method and settings of an image formation apparatus, for example, a printer.

In STEP S40, if it is determined that the high temperature malfunction has occurred, then the high temperature malfunction determination unit 150 creates a high temperature malfunction code, and writes it into the EEPROM unit 170, for example, an EEPROM (STEP S50); otherwise the determination processing goes back to STEP S10.

While the present invention is described with reference to the specific embodiments chosen for purpose of illustration, it should be apparent that the present invention is not limited to these embodiments, but numerous modifications could be made thereto by those people skilled in the art without departing from the basic concept and scope of the present invention.

The present application is based on Chinese Priority Patent Application No. 201110091205.1 filed on Mar. 31, 2011, the entire contents of which are hereby incorporated by reference.

What is claimed is:

1. A heat roller control device configured to control heating carried out with regard to a heat roller of an external fuser unit by controlling an external electrical power unit, comprising:

a high temperature malfunction detection unit configured to receive a temperature value detected by a heat roller temperature sensor, wherein, if the temperature value is greater than or equal to a predetermined high temperature threshold value, the high temperature malfunction detection unit generates a high temperature malfunction detection signal and sends the high temperature malfunction detection signal to an electrical power control unit and a temperature value processing unit;

the electrical power control unit configured to cut off, when receiving the high temperature malfunction detection signal, power feeding to the heat roller from the electrical power unit so that the heating of the heat roller is stopped;

an analog-to-digital converter configured to periodically convert plural of the temperature values from the heat roller temperature sensor to plural digital temperature values;

a temperature value storage unit configured to receive and store the plural digital temperature values from the analog-to-digital converter;

the temperature value processing unit configured to read from the temperature value storage unit, at the time when the high temperature malfunction detection signal is received, a digital temperature value corresponding to a specified detection time point generating the high temperature malfunction detection signal and one or more digital temperature values corresponding to a predetermined number of the detection time points backward from the specified detection time point, and processes the digital temperature values read to generate process data, and then send the processed data to a high temperature malfunction determination unit; and the high temperature malfunction determination unit configured to receive the processed data, and then based on the processed data, determine whether the high temperature malfunction has occurred, wherein, if it is determined that the high temperature malfunction has occurred, then the high temperature malfunction determination unit generates a high temperature malfunction code, and writes the high temperature malfunction code into a read-only memory unit.

2. The heat roller control device according to claim 1, wherein: the processed data refers to an average value of the digital temperature values read; if the average value is greater than or equal to a predetermined first threshold value, then the high temperature malfunction determination unit determines that the high temperature malfunction has occurred; and if the average value is less than the predetermined first threshold value, then the high temperature malfunction determination unit determines that the high temperature malfunction has not occurred.

3. The heat roller control device according to claim 1, wherein: the processed data refers to a maximum value of the digital temperature values read; if the maximum value is greater than or equal to a predetermined second threshold value, then the high temperature malfunction determination unit determines that the high temperature malfunction has occurred; and if the maximum value is less than the predetermined second threshold value, then the high temperature malfunction determination unit determines that the high temperature malfunction has not occurred.

4. The heat roller control device according to claim 1, wherein:

the processed data refers to a comparison result obtained by carrying comparison between a digital temperature value corresponding to a specified detection time point generating the high temperature malfunction detection signal and a digital temperature value corresponding to a detection time point just before the specified detection time point.

5. The heat roller control device according to claim 1, wherein:

if the high temperature malfunction determination unit determines that the high temperature malfunction has not occurred, then the high temperature malfunction determination unit sends a restart signal to the electrical power control unit; then the electrical power control unit restarts, based on the restart signal, the power feeding to the heat roller from the electrical power unit.

6. The heat roller control device according to claim 1, further comprising:

a notification unit configured to notify a user to restart the electrical power unit when the high temperature malfunction determination unit determines that the high temperature malfunction has not occurred.

7. An image formation apparatus comprising:

the heat roller control device according to claim 1.

* * * * *